US007293370B2

(12) United States Patent
Kaplan et al.

(10) Patent No.: US 7,293,370 B2
(45) Date of Patent: Nov. 13, 2007

(54) FITTING SYSTEM FOR CHILDREN'S FOOTWEAR

(75) Inventors: Joshua G. Kaplan, Somerville, MA (US); Patrick Y. Choe, Cambridge, MA (US); Sean B. Murphy, North Andover, MA (US)

(73) Assignee: New Balance Athletic Shoe, Inc., Brighton, MA (US)

( * ) Notice: Subject to any disclaimer, the term of this patent is extended or adjusted under 35 U.S.C. 154(b) by 381 days.

(21) Appl. No.: 10/985,544

(22) Filed: Nov. 10, 2004

(65) Prior Publication Data

US 2006/0096129 A1 May 11, 2006

(51) Int. Cl.
*A43D 1/00* (2006.01)
*A43B 3/26* (2006.01)

(52) U.S. Cl. ..... 36/8.4; 36/97; 36/73

(58) Field of Classification Search ..... 36/8.4 O, 36/97 X, 73 X

See application file for complete search history.

(56) References Cited

U.S. PATENT DOCUMENTS 1,176,572 A * 3/1916 Lassig ..... 36/1
1,515,086 A 11/1924 Baluta
1,685,538 A * 9/1928 Glidden et al. ..... 36/30 R
1,752,254 A 3/1930 Gosnell
2,304,936 A 12/1942 Lewis
2,803,895 A 8/1957 Frieder et al.
2,808,663 A 10/1957 Frieder et al.
2,920,008 A 1/1960 Frieder et al.
3,431,658 A 3/1969 Finn
3,810,318 A 5/1974 Epstein
4,137,654 A 2/1979 Hlavac
4,503,628 A 3/1985 Mancinelli et al.
4,642,916 A 2/1987 Collins
4,931,773 A 6/1990 Rosen
5,084,988 A 2/1992 Berger
5,285,583 A 2/1994 Aleven
5,842,292 A 12/1998 Siesel
5,996,255 A 12/1999 Ventura
5,996,257 A 12/1999 Harrison
6,029,373 A 2/2000 Diradour
6,151,803 A 11/2000 Charles (Continued)

FOREIGN PATENT DOCUMENTS

WO WO 01/93712 12/2001

*Primary Examiner*—Ted Kavanaugh
(74) *Attorney, Agent, or Firm*—Goodwin Procter LLP

(57) ABSTRACT

An object of footwear for children which allows adults to visually determine whether the shoe proper fits the child and can be adjusted in its effective size when it is determined that the shoe has become too small. The article of footwear comprises a fitting system comprising: (1) a substantially transparent window disposed in a predetermined location in the vamp so that when a wearer who has a foot that properly fits in the article of footwear puts on the article of footwear, a portion of a toe of the wearer can be seen through the window, and (2) a sizing member attached to the upper, the sizing member being placed within the opening against the heel portion to create a first effective size of the article of footwear, the sizing member being removable to create a second effective size of the article of footwear. The present invention also provides a method of determining when to adjust the effective size of an article of footwear and adjusting the effective size of the article of footwear.

52 Claims, 8 Drawing Sheets

U.S. PATENT DOCUMENTS

| | | | | |
|---|---|---|---|---|
| 6,167,639 | B1 | 1/2001 | Ventura | |
| 6,178,664 | B1 | 1/2001 | Yant et al. | |
| 6,279,251 | B1 | 8/2001 | Davis | |
| 6,368,989 | B1 | 4/2002 | Pascual et al. | |
| 6,438,872 | B1 | 8/2002 | Chil et al. | |
| 6,442,874 | B1 | 9/2002 | Long | |
| 6,584,707 | B1 | 7/2003 | Racine et al. | |
| 2002/0007568 | A1* | 1/2002 | Kellerman et al. | 36/28 |
| 2002/0043005 | A1 | 4/2002 | Blackburn et al. | |
| 2002/0083617 | A1 | 7/2002 | Tsou et al. | |
| 2003/0009907 | A1 | 1/2003 | Schuver et al. | |
| 2004/0025373 | A1 | 2/2004 | Schuver et al. | |
| 2004/0064975 | A1 | 4/2004 | Huff | |

* cited by examiner

FITTING SYSTEM FOR CHILDREN'S FOOTWEAR

BACKGROUND OF THE INVENTION

Footwear has direct effects on the development of children's feet. Inappropriate footwear can cause physical problems that may stay with a child into adulthood. Many of the children's shoes on the market are miniature versions of adult shoes, which are known in the fashion industry as "takedowns". Although these little shoes may have been modified in the fit and styling to make it appropriate for a child's foot, they are not designed specifically for children from scratch and therefore, fail to meet the special needs of children. Growing children have, for example, three characteristics associated with their feet and special needs for their footwear resulting from such characteristics.

With regard to the first characteristic, a proper fit in shoes is essential for children's ability to walk, run and play in comfort. Damage can be done to the feet of growing children if the children wear improperly or poorly fitting shoes such as continuing to wear shoes that they have already outgrown. Unfortunately, little children, for example, those under 3-years old, may not be able to tell when their shoes are getting tight. Older children, for example, 6-year-olds may not let their parents know that their favorite pairs of sneakers are starting to hurt. Usually adults can determine the fit of shoes only by pressing the toe boxes to see whether there is appropriate room in that area when the children are wearing the shoes. However, such determination is hardly reliable, especially when the toe boxes are stiff. Therefore, the principal problem in obtaining and maintaining proper fit in children's shoes stem from the difficulty of knowing the exact position of the outside perimeter of the toes when the foot is in the shoe.

Prior attempts have been made in the art to address this fitting problem by providing children's footwear with a transparent area on the upper or bottom of the footwear for visual sizing, for example, as described in the following prior art references:

U.S. Pat. No. 4,931,773 describes a shoe provided with at least one transparent area in the shoe bottom along with fitting indices to enable comparison of the outline of a foot in the shoe to the fitting indices.

U.S. Pat. No. 5,084,988 describes a shoe having a transparent area that is placed within the outsole and extends at least over about the front third of the outsole. The front part of the transparent area serves as a support for calibrated markings.

WO 01/93712 A1 describes footwear which includes an outsole and at least one substantially transparent window disposed in the outsole.

U.S. Patent Application Publication No. 2003/0009907 describes a shoe having a window portion associated with the upper portion for allowing viewing of a foot inserted into the shoe, and a reference mark associated with the insole liner for indicating proper fit.

U.S. Patent Application Publication No. 2004/0025373 describes a shoe having a window portion associated with the upper portion for allowing viewing of a foot inserted into the shoe, and a tab portion for covering and uncovering the window portion.

However, none of the above described transparent areas in the footwear for visual sizing are particularly successful or acceptable. Transparent areas located in the shoe bottom or outsole do not allow determination of the fit of a shoe when the wearer is standing up, whereas those transparent areas located in the shoe upper inevitably interfere with the anesthetic and protective properties of the upper. Therefore, there remains a need for children's footwear which allows visual fitting of the shoe without interfering with the anesthetic and protective properties of the shoe.

With regard to the second characteristic, children's feet grow fast and therefore, shoes of increasing sizes need to be purchased frequently to keep up with the pace of the growth of the feet. Frequent purchasing of shoes for children is not only costly but also time-consuming. To avoid frequent purchasing of shoes, many parents purchase shoes in larger sizes or have their children continue to wear the shoes that have been outgrown. Consequently, the children often times wear improperly or poorly fitting shoes, which may not only affect the children's athletic performance but also cause medical problems associated with the feet.

Some attempts have been made to solve the problem by adding adjustable sizing systems to children's athletic shoes, for example, as described in the following prior art references:

U.S. Pat. No. 6,442,874 describes an athletic shoe having a sizing member attached to the upper at the rear end of the shoe. The sizing member includes a preformed weakened separation line. The sizing member can be selectively positioned within or outside of the shoe and can be completely removed from the shoe by tearing or cutting off the sizing member at the preformed weakened separation line.

U.S. Pat. No. 6,584,707 describes an athletic shoe having a sizing system attached to the upper at the rear end of the shoe. The sizing system includes a first sizing element and a second sizing element which are removably attached together. At least one of the first and second elements is removably attached to the shoe upper. The sizing system allows a wearer to wear the shoes in three different effective lengths.

However, the above described sizing member and sizing system are not fully satisfactory. Once the sizing member or system described above is separated from the shoe by breaking the preformed separation line, it can not be reattached to the shoe when the wearer later feels that the shoe is still too big without the sizing member or system. In order to wear the shoe without the sizing member or system while avoiding permanent separation of the sizing member or system from the shoe and being able to use the sizing member again when needed, the wearer has to leave the sizing member or system at a position outside of the shoe, which is not only anesthetically undesirable but also may interfere with the wear's activities. Therefore, there remains a need for children's footwear which allows convenient and reversible adjustment of the effective size of the shoe to extend the effective life of the footwear.

With regard to the third characteristic, children's footwear is usually soft and pliable to avoid discomfort and constraints on children's feet. However, such soft and pliable materials of the shoes do not properly protect the children from injuries caused by hard objects such as pebbles and rocks, which are commonly present on parks, campgrounds and other outdoor spaces that children often go. When stepped on, such hard objects may cause considerable pain and, even worse, injuries to the child's foot.

Insoles capable of withstanding penetration of nails and other sharp objects have been developed in the prior art, for example, as described in the following prior art references:

U.S. Pat. No. 2,808,663 describes a laminated protective sole including a plurality of stacked fibrous laminates impregnated with synthetic resin, and a synthetic resin bond extending through all laminates over a minor area of the inner sole for retaining the laminates in stacked relationship.

U.S. Pat. No. 5,996,255 describes a puncture resistant insole for boots and other shoes. The puncture resistant insole includes multiple layers of a tightly woven, puncture resistant fabric, formed from high tensile strength synthetic or polymeric fibers.

U.S. Pat. No. 6,151,803 describes a puncture resistant insole which is constructed of a substantially flexible, substantially puncture resistant material, such as polymer fibers. The perimeter of the insole is curved upward, and includes a plurality of substantially v-shaped notches therein to enhance flexibility of the insole.

However, all of the above described insoles are designed for adult shoes and more specifically for heavy duty adult shoes, such as safety shoes for workers on manufacturing, construction and demolition sites. These prior art protective insoles are usually stiff, heavy and complex in constructions and therefore, will not be suitable for children, who usually involve in lighter activities and require higher flexibility and softness in their shoes to provide comfort and facilitate athletic performance. Therefore, there remains a need for children's footwear which provides protection from injuries by hard objects without diminishing the comfort of the child's foot or interfering with the child's activities.

In summary, there remains a need for an object of footwear which is specifically designed for children and meets all of the above described special needs for children's footwear without any of the above described disadvantages in the prior art. The present invention provides an article of footwear which is specifically designed for children. More specifically, the shoe according to the present invention not only allows adults to visually determine whether it proper fits the child but can also be adjusted in its effective size when it is determined that the shoe has become too small, such that the effective life of the shoe can be extended. Additionally, the shoe according to the present invention optionally includes a protective plate to provide protection from injuries by hard objects.

SUMMARY OF THE INVENTION

It is an object of the present invention to provide a shoe having a fitting system which allows adults to visually determine whether the shoe proper fits the child and can be adjusted in its effective size when it is determined that the shoe has become too small.

It is another object of the present invention to provide a shoe provided with a viewing window which has an appropriate dimension and location in the shoe upper to visually aid in fitting of the shoe without interfering with the anesthetic and protective properties of the shoe.

It is also an object of the present invention to provide a sizing member for a shoe which is detachable and re-attachable to the shoe for reversibly adjusting the effective size of the shoe.

It is another object of the present invention to provide a protection plate for a shoe, preferably removable from the shoe, for protecting the wearer's foot from pain and injuries caused by hard objects.

In accordance with an aspect of the present invention, there is provided an article of footwear comprising: a sole including an insole and an outsole; an upper or shell secured to the sole and defining an opening for receiving a foot of a wearer, the upper including a vamp and a heel portion; and a fitting system comprising: (1) a substantially transparent window disposed in a predetermined location in the vamp so that when a wearer who has a foot that properly fits in the article of footwear puts on the article of footwear, a portion of a toe of the wearer can be seen through the window, and (2) a sizing member attached to the upper, the sizing member being placed within the opening against the heel portion to create a first effective size of the article of footwear, the sizing member being removable to create a second effective size of the article of footwear.

In accordance with another aspect of the present invention, there is provided an article of footwear comprising: a sole including an insole and an outsole; an upper secured to the sole and defining an opening for receiving a foot of a wearer, the upper including a vamp, the vamp having a medial front portion and a lateral front portion; and a substantially transparent window disposed in a predetermined location in the medial front portion of the vamp so that when a wearer who has a foot that properly fits in the article of footwear puts on the article of footwear, a portion of a toe of the wearer can be seen through the window, wherein the substantially transparent window is substantially circular.

In accordance with a further aspect of the present invention, there is provided an article of footwear comprising: a sole including an insole and an outsole; an upper secured to the sole and defining an opening for receiving a foot of a wearer, the upper including a heel portion; and a sizing member attached to the upper, the sizing member being placed within the opening against the heel portion to create a first effective size of the article of footwear, the sizing member being removable to create a second effective size of the article of footwear, the sizing member, once removed, being re-attachable to said upper.

In accordance with another aspect of the present invention, there is provided an article of footwear comprising: a sole including an insole and an outsole; an upper secured to the sole for receiving a foot of a wearer; and a protective plate under the insole for providing protection from injuries by hard objects, the protective plate being made of a material which is more resistant to hard objects than the outsole. The protective plate can be combined with anyone of the above described aspects of the present invention.

In accordance with a further aspect of the present invention, there is provided a method of determining when to adjust the effective size of an article of footwear and adjusting the effective size of the article of footwear, the article of footwear comprising a sole; an upper secured to the sole and defining an opening for receiving a foot of a wearer, the upper including a vamp and a heel portion; and a fitting system comprising a substantially transparent window disposed in a predetermined location in the vamp and a sizing member; the method comprising the step of: (1) positioning the sizing member within the opening; (2) viewing a toe of the wearer through the substantially transparent window to determine the location of the toe relative to the article of footwear; and (3) removing the sizing member when the tip of the toe appears to extend beyond a predetermined position in the substantially transparent window.

DETAILED DESCRIPTION OF THE INVENTION

The present invention provides an article of footwear which comprises a fitting system comprising: (1) a substantially transparent window disposed in a predetermined location in the upper so that when a wearer who has a foot that properly fits in the article of footwear puts on the article of footwear, a portion of a toe of the wearer can be seen through the window, and (2) a sizing member removably attached to a heel portion of the upper to create a first effective size of the article of footwear, the sizing member being removable to create a second effective size of the article of footwear. Optionally, the article of footwear comprises a protective plate under the insole for providing protection from injuries by hard objects, the protective plate being made of a material which is more resistant to hard objects than the outsole.

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

Figure 1:
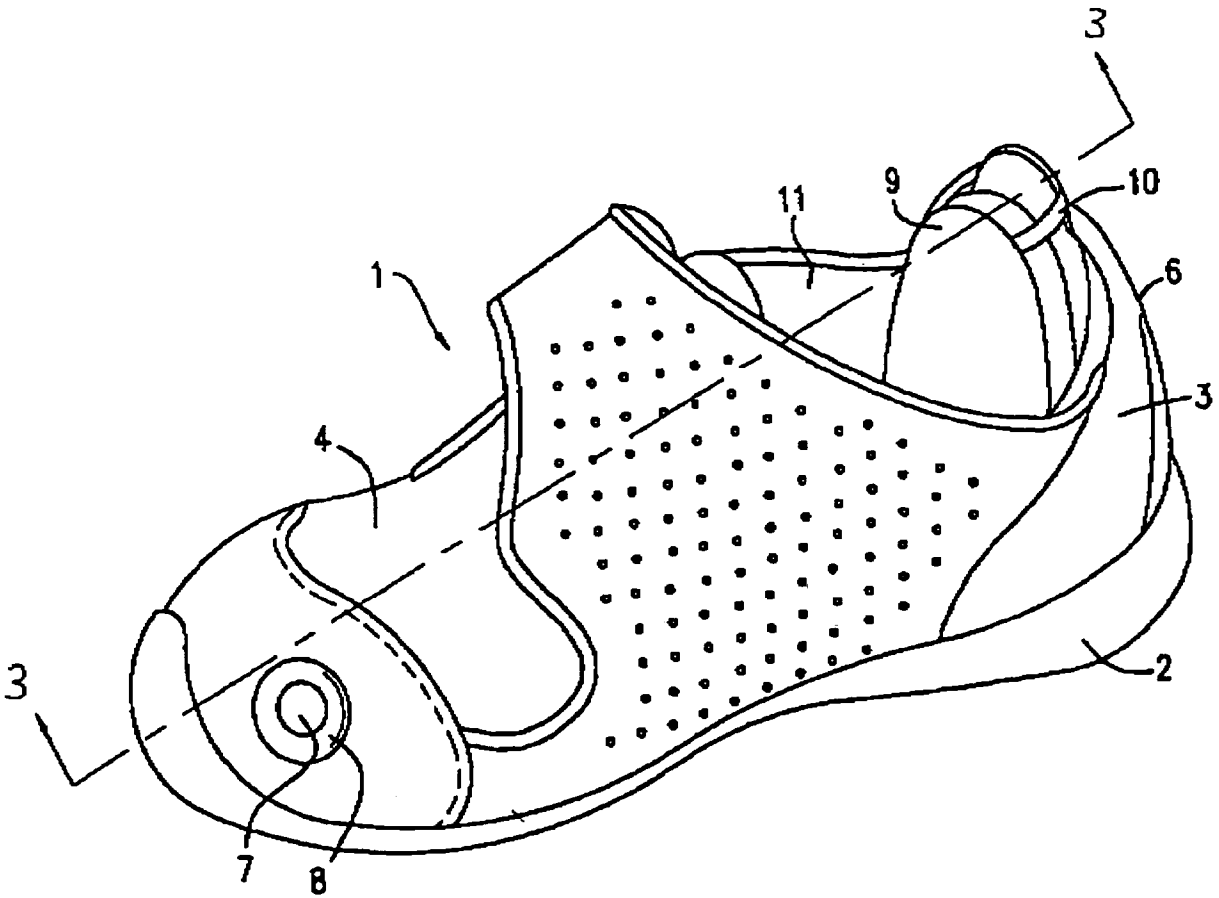
FIG. 1 is a prospective view illustrating a shoe having a viewing window and an attached sizing member in accordance with the present invention.
Figure 2:
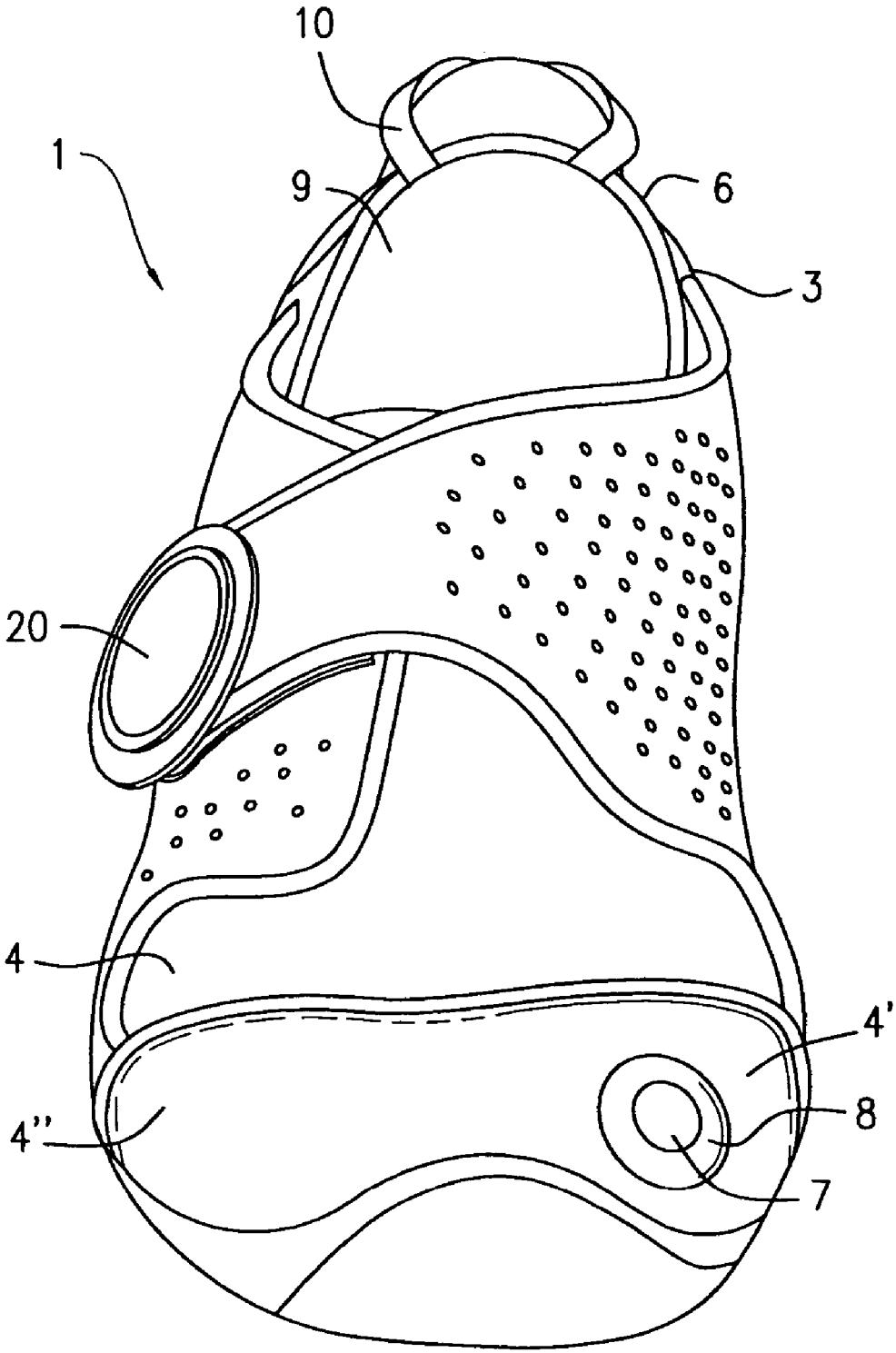
FIG. 2 is a front view of the shoe.

FIGS. 1 and 2 illustrate a preferred embodiment of the present invention. The shoe 1 has a sole 2 and an upper 3. The upper includes a vamp 4 and a heel portion 6. The vamp has a medial front portion 4' and a lateral front portion 4". The shoe has a substantially transparent window 7 disposed in the medial front portion 4' of the vamp 4. Preferably, the window 7 is disposed in a predetermined location in the medial front portion 4' of the vamp 4 so that when a wearer who has a foot that properly fits in the shoe puts on the, a portion of a toe of the wearer can be seen through the window. The term "a wearer who has a foot that properly fits in the shoe" used herein means a person who has a foot of a size that is approximately the same as the size of the shoe or no more than 1 and a half size, preferably 1 size, and more preferably half a size, bigger or smaller than the shoe. Preferably, the window is disposed at a location corresponding to the tip of a big toe of a wearer, allowing viewing of a portion of the big toe. However, the window can also be disposed in a location corresponding to the second toe or any other toe or toes as long as it allows viewing of at least a portion of the wearer's toe. When the wearer wears a sock, the sock covered toe can be observed through the window. The substantially transparent window 7 has a border 8. This border 8 is decorative and is optional for the shoe of the present invention. The upper 3 includes a Velcro® fastening system 20 for fastening the shoe.

The shoe of the present invention has a front, a medial side and a bottom. The substantially transparent window is disposed about 10 to 30 mm, preferably about 15 to 25 mm, more preferably about 19 to 21 mm, and most preferably about 20 mm, from the front, about 2 to 22 mm, preferably about 7 to 17, more preferably about 11 to 13 mm, and most preferably about 12 mm, from the medial side, and about 15 to 35 mm, preferably about 20 to 30 mm, more preferably about 24 to 26 mm, and most preferably about 25 mm, from the bottom.

In a preferred embodiment of the present invention, the substantially transparent window is circular having a diameter of less than about 20 mm, preferably about 3-10 mm, more preferably about 6-8 mm, and most preferably about 7 mm. In a most preferred embodiment, the diameter of the circular window approximately equals one full size of the shoe. Although a substantially circular window is preferred, it is also possible and contemplated that the window may be oval, square, triangular or of any other shapes as long as observation of one or more toes of a wearer through the window is allowed.

The substantially transparent window has a thickness of about 0.3 to 3 mm, preferably about 0.5 to 2.5 mm, more preferably about 1 to 2 mm, and most preferably about 1.5 mm.

The substantially transparent or translucent window can be produced from any substantially transparent or translucent material that is flexible, durable and pliable. Preferably, the material is resistant to abrasion and wear without remarkable loss of the optical properties over time. Examples of suitable materials for the window include, but are not limited to, a plastic material, for example, a vinyl polymer such as polyvinyl chloride (PVC), polyolefin, polystyrene, polymethacrylate, polycarbonate, thermoplastic polyacrylonitrile, and polyurethane, and rubber including synthetic rubber and natural rubber. A preferred material for the window is a vulcanized rubber.

For production of the window, it may be compression molded using any suitable material, such as a vulcanized type of rubber, cast using silicone, thermoplastic polyurethane (TPU) or PVC. Alternatively, an extruded thermoplastic film, such as TPU, ethylene vinyl acetate (EVA) and PVC, can be die cut to produce the windows.

Figure 3:
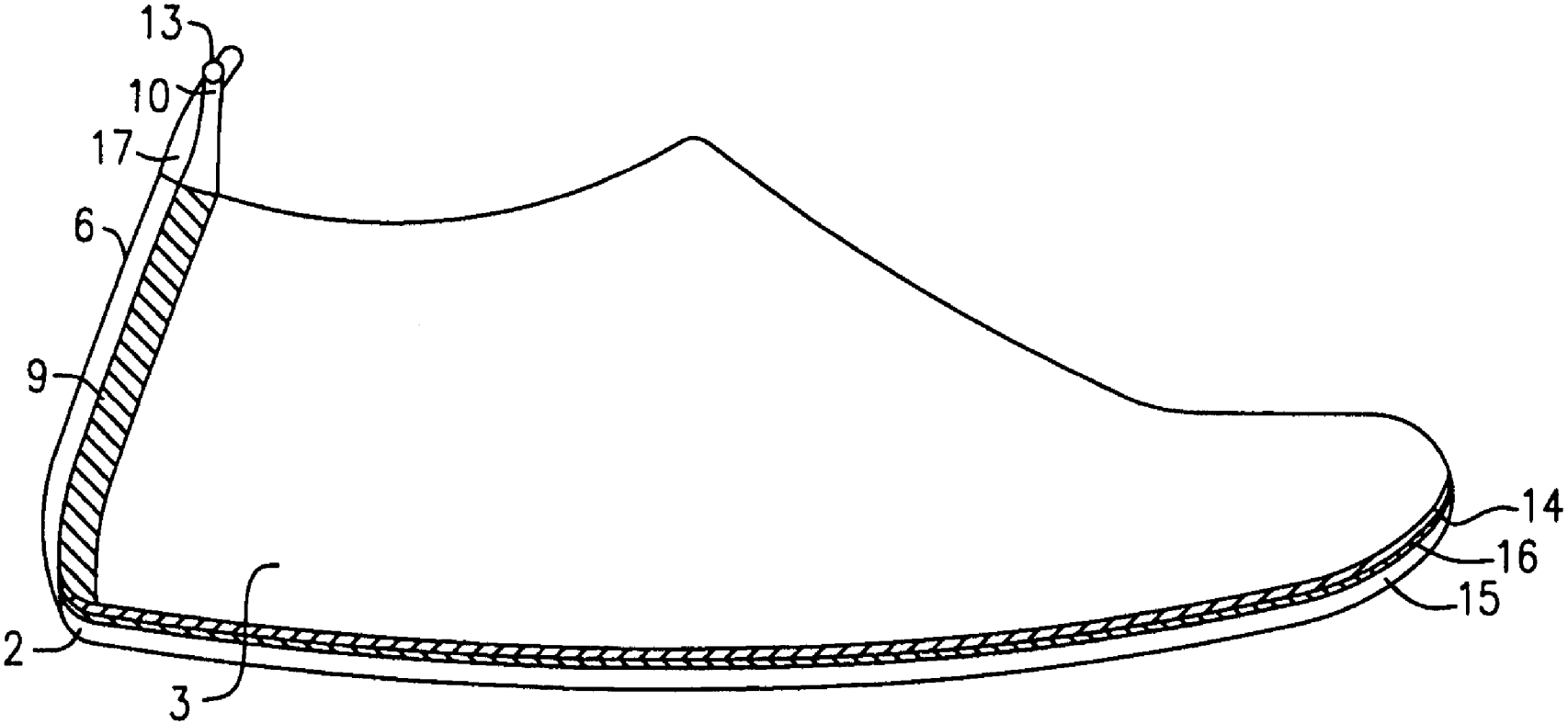
FIG. 3 is a sectional view taken along line A-A of FIG. 1.
Figure 4:
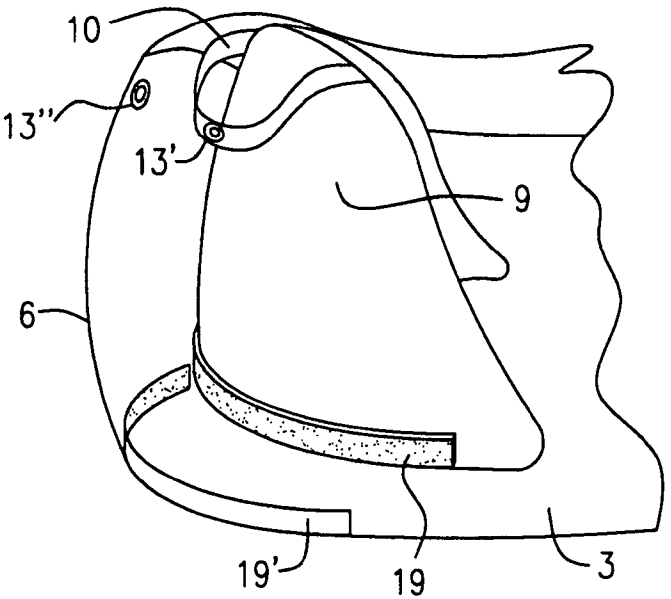
FIG. 4 is a prospective view of a first embodiment of a sizing member in accordance with the present invention.

As shown in FIGS. 1, 2 and 3, the preferred embodiment of the present invention has a sizing member 9 which is removably attached to an upward extension 17 of the upper 3 through a snap 13 and placed within a shoe opening 11 against the heel portion 6 for reducing the effective size of the shoe 1. Preferably the sizing member engages the wearer's heel to provide a comfortable fit. The upper portion of the sizing member may have an extension, for example, a loop extension 10. In this preferred embodiment, corresponding male and female parts 13', 13" of a snap 13 are respectively disposed on a loop extension 10 of the sizing member 9 and a corresponding position on the heel portion 6 of the upper 3, as shown in FIG. 4. Although the extension is a loop extension in the preferred embodiment, the extension can be of any configuration, for example, a strap connected to the upper portion of the sizing member.

Although a snap is used in the preferred embodiments of the present invention, other attachment mechanism may be used as long as it provides removable attachment of the sizing member to the upper of the shoe. Preferably the attachment mechanism allows the sizing member to be removable and re-attachable to the shoe for reversible adjustment the effective size of the shoe. Suitable attachment mechanisms include, but are not limited to, hook and loop closure systems, adhesives and other mechanical locking systems such as snaps and buttons.

Preferably, the attachment mechanism is disposed in an extension of the sizing member and its corresponding position in an extension of the heel portion of the upper. However, such extensions are optional. The attachment mechanism can be disposed anywhere in the sizing member and a corresponding location on the upper.

The shoe may further comprise a stabilizing mechanism for holding the sizing member in place within the shoe opening. FIG. 4 illustrates an example of the stabilizing mechanism comprising a hook and loop system, which is commercially available under Velcro®. The sizing member 9 has a loop extension 10 which has a snap 13 for removable attachment to the heel portion 6 of the upper 3. The sizing member 9 has a stabilizing mechanism in the form of a strip of one part of Velcro® 19 and the heel portion 6 of the upper 3 has a strip of the mating part of the Velcro® 19' at a corresponding location. Preferably, the hook and loops strips are located on a lower portion of the sizing member 9 and a lower portion of the heel portion 6 of the upper 3 to avoid discomfort that the strip may cause the wearer when the sizing member 9 is not attached to the shoe.

Figure 5:
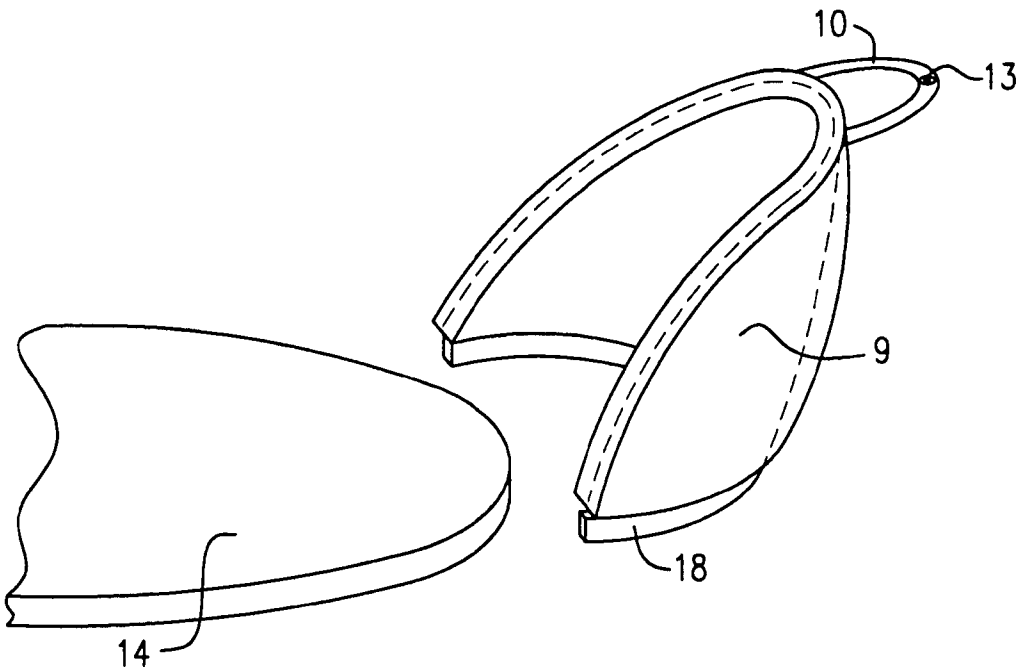
FIG. 5 is a prospective view of a second embodiment of a sizing member in accordance with the present invention.

FIG. 5 illustrates another example of a stabilizing mechanism. The sizing member 9 has a loop extension 10 with a snap 13, and a stiff element 18 extending from the lower portion of the sizing member 9 for engaging with the insole 14. Preferably, the stiff element is a plastic element sewn along a lower end of the sizing member 9. When the shoe is worn, the insole 14 presses up against the stiff element 18 to stabilize the sizing member 9. Preferably, the stiff element is a plastic element sewn along a lower end of the sizing member. When the shoe is worn, the insole presses up against the stiff element to lock the sizing member in place.

In another alternative embodiment, the stabilizing mechanism is an extension for placement under the insole. Specifically, the sizing member includes a flat element substantially perpendicularly connected to the lower portion of the sizing member for placement under the insole to stabilize the sizing member.

In addition to the above, the sizing member may also be stabilized as one piece with the insole or by being connected, such as sewn, to the insole and be separable from the insole by breaking a preformed weakened separation line, such as a line of perforation, between the sizing member and the insole. Additional possible stabilizing mechanisms include adhesives and other mechanical locking systems.

The sizing member comprises a cushion which is soft and substantially corresponds to the contour of the inner of the heel portion of the upper. The sizing member may have a compressible core enclosed in a casing. Alternatively, the sizing member may have multiple layers of soft and compressible materials.

The sizing member has a desirable thickness so that when it is attached to the shoe in an in-use position, it can reduce the effective size of the shoe for about one half to one and a half shoe size, preferably for about one half to one shoe size, and more preferably for about one half shoe size. The term "shoe size" used herewith refers to the shoe size used in the American standard shoe sizing system for children, which can be converted into a shoe size of other sizing systems known in the art.

Optionally, the shoe of the present invention is provided with a protective plate under the insole for providing protection from pain and injuries caused by hard objects such as pebbles and rocks, the protective plate being configured substantially the same as the insole and made of a material which is more resistant to hard objects than the outsole.

As illustrated in FIG. 3, the sole 2 includes an insole 14 and an outsole 15, and a protective plate 16 placed under the insole 14. Preferably, the protective plate is removable from and reinsertable to the shoe. The protective plate can be removed from the shoe by lifting an end of the insole thus allowing removal of the protective plate under the insole. Alternatively, the protective plate can be taken out of the shoe after the insole is completely removed from the shoe. Optionally, the bottom side of the insole may be provided with a layer of double-sided tape or any other conventional means to assist in holding the protective plate in place when the protective plate is placed under the insole. Alternatively, the layer of double-sided tape or the other conventional means for holding the protective plate in place may be provided on the top side of the outsole.

Figure 6:
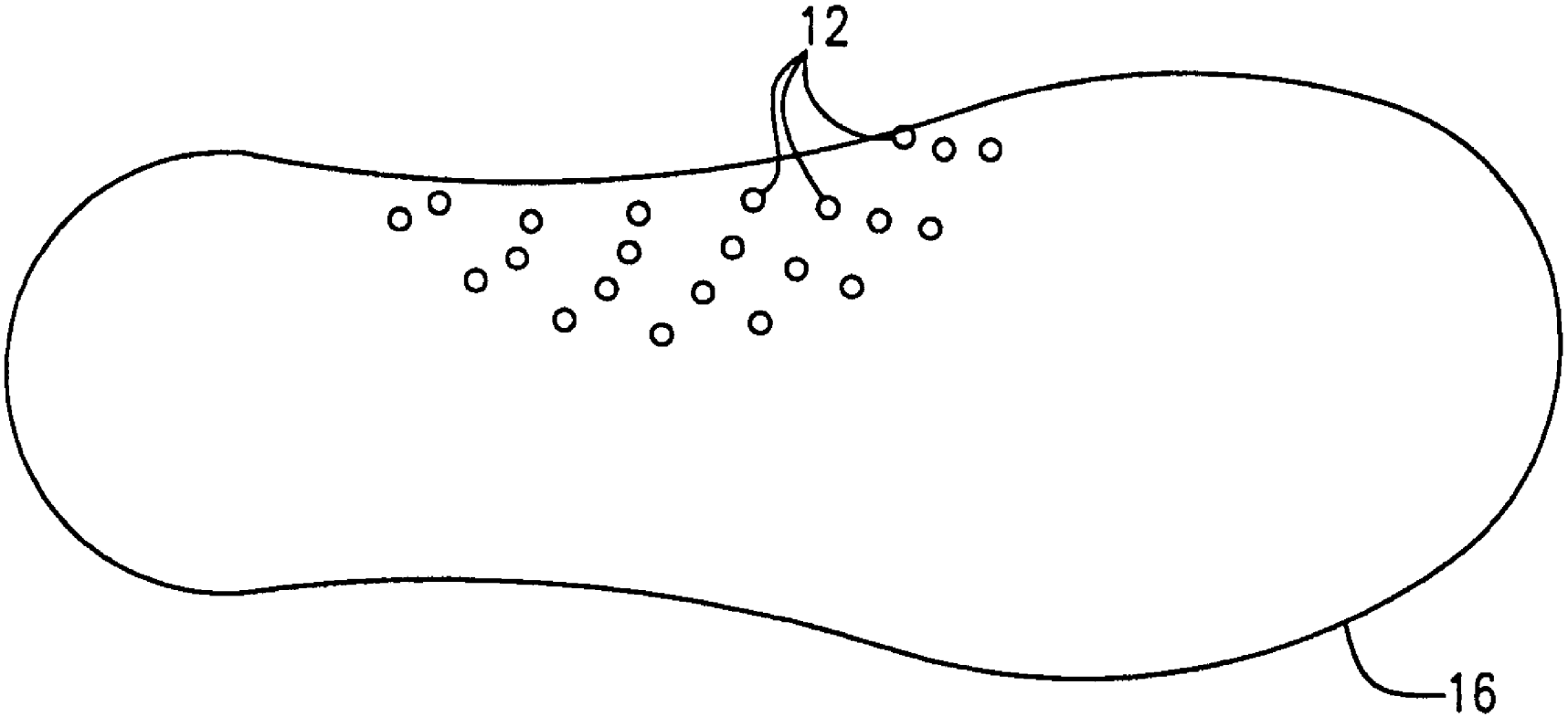
FIG. 6 is a top plan view of a protective plate in accordance with the present invention.

Optionally, the protective plate may be at least partially perforated to facilitate aeration. In a preferred embodiment, an area at the central medial region of the protective plate has perforations 12 as shown in FIG. 6. It is also possible to have perforations over the entire surface of the protective plate provided that the number and size of the holes are not too big to diminish the protective property of the protective plate. Preferably, the insole is perforated corresponding to the protective plate for better aeration.

The protective plate can be produced from any semi-rigid material that can provide acceptable protection. Examples of suitable materials for the protective plate include, but are not limited to, a plastic material, for example, a vinyl polymer such as polyvinyl chloride (PVC), polyolefin, polystyrene, polymethacrylate, polycarbonate, thermoplastic polyacrylonitrile, and polyurethane. A preferred material for the protective plate is TPU. It is also possible to prepare the protective plate from a combination of the above described materials. The protective plate may be constructed as a single layer or a plurality of layers connected together.

Although the protective plate is preferably configured substantially the same as the insole so that the entire bottom of the foot is protected from injuries by hard objects, it is also possible to configure the protective plate in any size and shape to protect a selected area of the foot.

Figure 7:
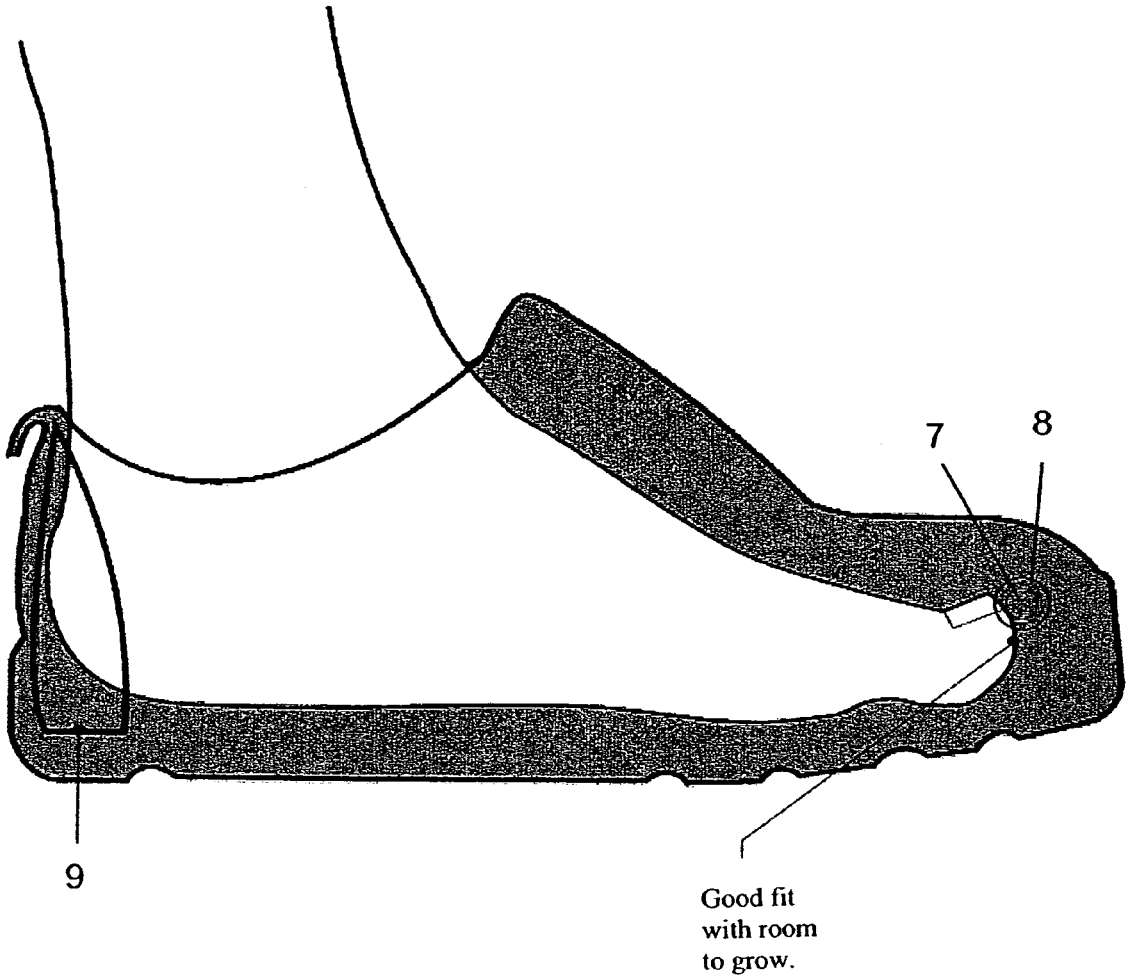
FIG. 7 illustrates a wearer's foot in a shoe of the present invention at the first stage of the effective life of the shoe with a sizing member attached when the shoe provides a good fit with room for the foot to grow.
Figure 8:
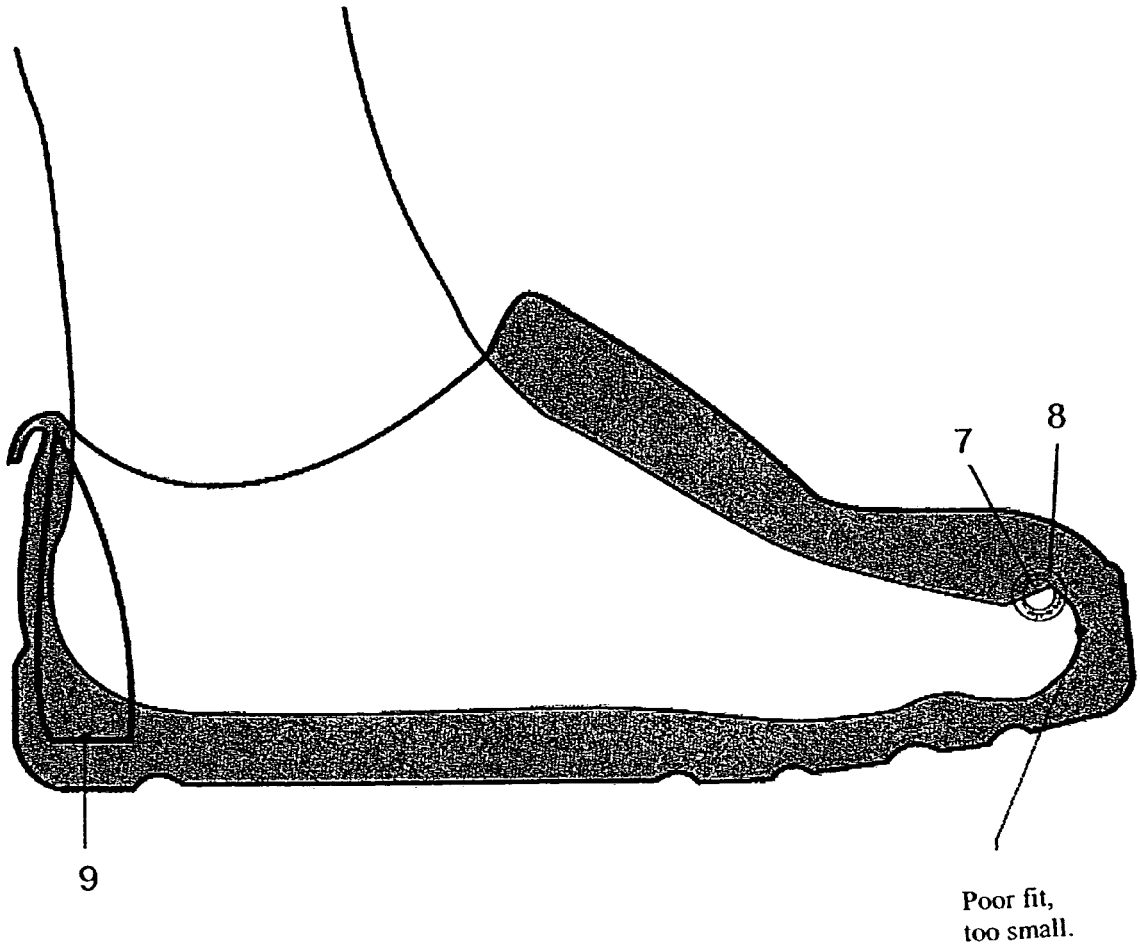
FIG. 8 illustrates a wearer's foot in a shoe of the present invention at the second stage of the effective life of the shoe with a sizing member attached when the shoe becomes too small.
Figure 9:
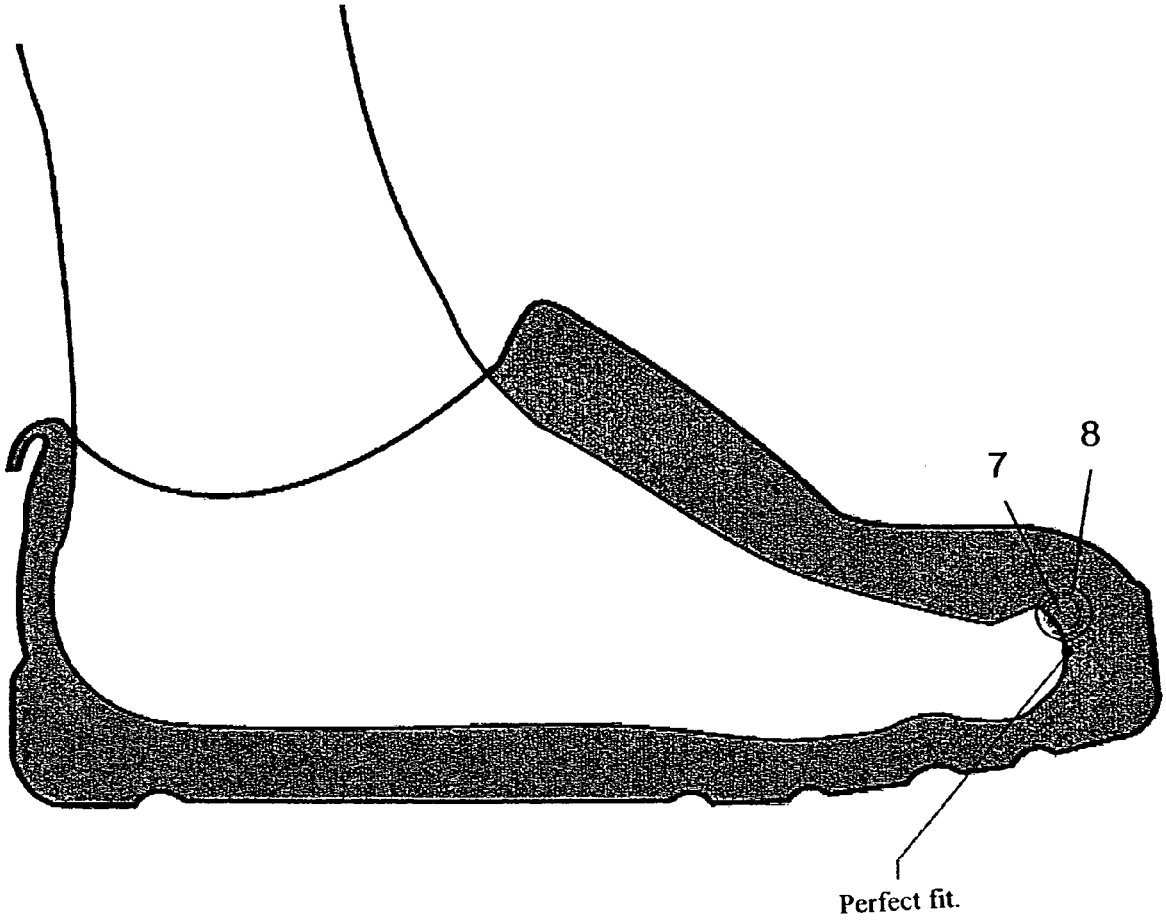
FIG. 9 illustrates a wearer's foot in a shoe of the present invention at the third stage of the effective life of the shoe with the sizing member removed so that the shoe provides a perfect fit again.

FIGS. 7-9 illustrate the use of an exemplary embodiment of the present invention.

FIG. 7 illustrates the preferred position of a wearer's foot in the shoe when the shoe is new. At this first stage of the effective life of the shoe, the sizing member 9 should be used. When the foot is observed from straight above the substantially transparent window 7, the tip of the toe can be seen at the rear end of the window. At this first stage, the shoe provides a good fit for the foot with room for the foot to grow.

FIG. 8 illustrates the second stage of the effective life of the shoe. After a period of time, the foot almost outgrows the shoe. When the foot is observed through the substantially transparent window 7, the tip of the toe extends to the front end of the window. At this second stage, the shoe is too small and provides a poor fit for the foot. This is the time when the sizing member 9 should be removed.

FIG. 9 illustrates the third stage of the effective life of the shoe. Once the sizing member 9 is removed, the shoe again provides a perfect fit. The shoe of the present invention therefore has an extended effective life over shoes without the sizing member.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

The invention claimed is:

1. An article of footwear comprising: a sole; an upper secured to said sole and defining an opening for receiving a foot of a wearer, said upper including a vamp and a heel portion; and a fitting system comprising: a substantially transparent window disposed in a predetermined location in said vamp so that when a wearer who has a foot that properly fits in said article of footwear puts on said article of footwear, a portion of a toe of said wearer can be seen through said window; and a sizing member attached to said upper, said sizing member being placed within said opening against said heel portion to create a first effective size of said article of footwear, said sizing member being reattachably removable from said article of footwear through an attachment mechanism to create a second effective size of said article of footwear, said attachment mechanism allowing said sizing member, once removed, to be reattached to said article of footwear, wherein said sizing member has an upper portion and a lower portion, and an extension extending from said upper portion of said sizing member.

2. The article of footwear of claim 1, wherein said vamp having a medial front portion and a lateral front portion, and said substantially transparent window is disposed in a predetermined location in said medial front portion of said vamp so that when a wearer who has a foot tax properly fits in said article of footwear puts on said article of footwear, a portion of a toe of said wearer can be seen through said window.

3. The article of footwear of claim 1, wherein said substantially transparent window is disposed in a location on said vamp so that a portion of a big toe of said wearer can be seen through said window.

4. The article of footwear of claim 1, also having a front, a medial side and a bottom, wherein said substantially transparent window is disposed about 10 to 30 mm from said front, about 2 to 22 mm from said medial side, and about 15 to 35 mm from said bottom.

5. The article of footwear of claim 1, also having a front, a medial side and a bottom, wherein said substantially transparent window is disposed about 15 to 25 mm from said front, about 7 to 17 mm from said medial side, and about 20 to 30 mm from said bottom.

6. The article of footwear of claim 1, also having a front, a medial side and a bottom, wherein said substantially transparent window is disposed about 19 to 21 mm from said front, about 11 to 13 mm from said medial side, and about 24 to 26 mm from said bottom.

7. The article of footwear of claim 1, also having a front, a medial side and a bottom, wherein said substantially transparent window is disposed about 20 mm from said front, about 12 mm from said medial side, and about 25 mm from said bottom.

8. The article of footwear of claim 1, wherein said substantially transparent window is substantially circular.

9. The article of footwear of claim 8, wherein said substantially transparent window has a diameter of less than about 20 mm.

10. The article of footwear of claim 8, wherein said substantially transparent window has a diameter of about 3-10 mm.

11. The ankle of footwear of claim 8, wherein said substantially transparent window has a diameter of about 6-8 mm.

12. The article of footwear of claim 1, wherein said substantially transparent window has a thickness of about 0.3 to 3 mm.

13. The article of footwear of claim 1, wherein said substantially transparent window has a thickness of about 0.5 to 2.5 mm.

14. The article of footwear of claim 1, wherein said substantially transparent window has a thickness of about 1 to 2 mm.

15. The article of footwear of claim 1, wherein said substantially transparent window has a thickness of about 1.5 mm.

16. The article of footwear of claim 1, wherein said substantially transparent window is comprised of a compression molded rubber.

17. The article of footwear of claim 1, also having a front, a medial side and a bottom, wherein said substantially transparent window is a substantially circular window having a diameter of about 6-8 mm, the center of said circular window is about 19 to 21mm from said front, about 11 to 13 mm from said medial side, and about 24 to 26 mm from said bottom, allowing observing a portion of the big toe and/or the second toe of a foot of said wearer.

18. The ankle of footwear of claim 1, wherein said sizing member is attached to said upper through said attachment mechanism, wherein said attachment mechanism allows said sizing member, once removed, to be reattached to said article of footwear at said upper.

19. The article of footwear of claim 1, wherein said sizing member has a thickness for reducing the effective size of said ankle of footwear for about one half to one and a half shoe size.

20. The article of footwear of claim 1, wherein said sizing member has a thickness for reducing the effective size of said article of footwear for about one half to one shoe size.

21. The article of footwear of claim 1, wherein said siring member has a thickness for reducing the effective size of said article of footwear for about one half shoe size.

22. An article of footwear comprising: a sole; an upper secured to said sole and defining an opening for receiving a foot of a wearer, said upper including a vamp and a heel portion; and a fitting system comprising: a substantially transparent window disposed in a predetermined location in said vamp so that when a wearer who has a foot that properly fits in said article of footwear puts on said article of footwear, a portion of a toe of said wearer can be seen through said window; and a sizing member attached to said upper, said sizing member being placed within said opening against said heel portion to create a first effective size of said article of footwear, said sizing member being reattachably removable from said article of footwear through an attachment mechanism to create a second effective size of said article of footwear, said attachment mechanism allowing said sizing member, once removed, to be reattached to said article of footwear, wherein said attachment mechanism is a snap.

23. The article of footwear of claim 1, wherein said attachment mechanism is disposed in said extension.

24. The article of footwear of claim 1, wherein said extension is a loop connected to said upper portion of said sizing member.

25. The article of footwear of claim 1, further comprising a stabilizing mechanism for holding said sizing member in place within said opening.

26. The article of footwear of claim 25, wherein said stabilizing mechanism is a hook and loop closure system.

27. The article of footwear of claim 26, wherein said sizing member includes a strip of one of hooks and loops and said heel portion of said upper includes a strip of the other of hooks and loops at a corresponding location.

28. The article of footwear of claim 27, wherein said strips are located on said lower portion of said sizing member and a lower portion of said heel portion of said upper.

29. The article of footwear of claim 1, wherein said sole comprises an insole and an outsole, said article of footwear further comprising: a protective plate under said insole for providing protection from injuries by hard objects, said protective plate being made of a material which is more resistant to hard objects than said outsole.

30. The article of footwear of claim 29, wherein said protective plate is removable from said article of footwear.

31. The article of footwear of claim 29, wherein said protective plate is made of a plastic material.

32. The article of footwear of claim 31, wherein said plastic material is thermoplastic polyurethane (TPU).

33. The article of footwear of claim 32, wherein said protective plate is at least partially perforated to facilitate aeration.

34. The article of footwear of claim 29, wherein said protective plate is configured substantially the same as said insole.

35. An article of footwear comprising: a sole; an upper secured to said sole and defining an opening for receiving a foot of a wearer, said upper having a heel portion; and a sizing member attached to said upper, said sizing member being placed within said opening against said heel portion to create a first effective size of said article of footwear, said sizing member being reattachably removable from said article of footwear though an attachment mechanism to create a second effective size of said article of footwear, said sizing member, once removed, being re-attachable to said article of footwear upper through said attachment mechanism, wherein said sizing member has an upper portion and a lower portion, and an extension extending from said upper portion of said sizing member.

36. The article of footwear of claim 35, wherein said sizing member is attached to said upper through said attachment mechanism, wherein said attachment mechanism allows said sizing member, once removed, to be reattached to said article of footwear at said upper.

37. The article of footwear of claim 35, wherein said sizing member has a thickness for reducing the effective size of said article of footwear for about one half to one and a half shoe size.

38. The article of footwear of claim 35, wherein said sizing member has a thickness for reducing the effective size of said article of footwear for about one half to one shoe size.

39. The article of footwear of claim 35, wherein said sizing member has a thickness for reducing the effective size of said article of footwear for about one half shoe.

40. The article of footwear of claim 35, wherein said extension is a loop connected to said upper portion of said sizing member.

41. An article of footwear comprising: a sole; an upper secured to said sole and defining an opening for receiving a foot of a wearer, said upper having a heel portion; and a sizing member attached to said upper, said sizing member being placed within said opening against said heel portion to create a first effective size of said article of footwear, said sizing member being reattachably removable from said article of footwear through an attachment mechanism to create a second effective size of said article of footwear, said sizing member, once removed, being re-attachable to said article of footwear upper through said attachment mechanism, wherein said sizing member is attached to said upper through said attachment mechanism, wherein said attachment mechanism allows said sizing member, once removed, to be reattached to said article of footwear at said upper, and wherein said attachment mechanism is a snap.

42. The article of footwear of claim 41, wherein said attachment mechanism is disposed in said extension.

43. The article of footwear of claim 35, further comprising a stabilizing mechanism for holding said sizing member in place within said opening.

44. The article of footwear of claim 43, wherein said stabilizing mechanism is a hook and loop closure system.

45. The article of footwear of claim 44, wherein said sizing member includes a strip of one of hooks and loops and said heel portion of said upper includes a strip of the other of hooks and loops at a corresponding location.

46. The article of footwear of claim 45, wherein said strips are located on said lower portion of said sizing member and a lower portion of said heel portion of said upper.

47. The article of footwear of claim 35, wherein said sole comprises an insole and an outsole, said article of footwear further comprising: a protective plate under said insole for providing protection from injuries by hard objects, said protective plate being made of a material which is more resistant to hard objects than said outsole.

48. The article of footwear of claim 47, wherein said protective plate is removable from said article of footwear.

49. The article of footwear of claim 47, wherein said protective plate is made of a plastic material.

50. The article of footwear of claim 49, wherein said plastic material is thermoplastic polyurethane (TPU).

51. The article of footwear of claim 47, wherein said protective plate is at least partially perforated to facilitate aeration.

52. The article of footwear of claim 47, wherein said protective plate is configured substantially the same as said insole.

* * * * *